US010670256B2

(12) United States Patent
Mertens et al.

(10) Patent No.: US 10,670,256 B2
(45) Date of Patent: Jun. 2, 2020

(54) LIGHTING MODULE WITH INCLINED LED MOUNTING SURFACE

(71) Applicant: Lumileds Holding B.V., Schiphol (NL)

(72) Inventors: Jürgen Mertens, Wuerselen (DE); Harry Gijsbers, Heerlen (NL); Astrid Marchewka, Aachen (DE); Benno Spinger, Aachen (DE)

(73) Assignee: Lumileds Holding B.V., Schiphol (NL)

( * ) Notice: Subject to any disclaimer, the term of this patent is extended or adjusted under 35 U.S.C. 154(b) by 0 days.

(21) Appl. No.: 16/444,407

(22) Filed: Jun. 18, 2019

(65) Prior Publication Data

US 2019/0383479 A1 Dec. 19, 2019

(30) Foreign Application Priority Data

Jun. 19, 2018 (EP) ..... 18178452

(51) Int. Cl.

| | |
|---|---|
| ***F21V 21/00*** | (2006.01) |
| ***F21V 29/70*** | (2015.01) |
| ***F21V 7/00*** | (2006.01) |
| ***F21V 19/00*** | (2006.01) |
| ***F21V 23/06*** | (2006.01) |

(52) U.S. Cl.

CPC ..... *F21V 29/70* (2015.01); *F21V 7/0083* (2013.01); *F21V 19/0015* (2013.01); *F21V 23/06* (2013.01)

(58) Field of Classification Search

CPC .... F21V 29/70; F21V 7/0083; F21V 19/0015; F21V 23/06

USPC ..... 362/294, 547, 545, 652

See application file for complete search history.

(56) References Cited

U.S. PATENT DOCUMENTS

| | | | | |
|---|---|---|---|---|
| 6,773,138 | B2 * | 8/2004 | Coushaine | F21V 29/76 362/656 |
| 7,008,095 | B2 * | 3/2006 | Coushaine | F21K 9/00 362/545 |
| 7,806,562 | B2 * | 10/2010 | Behr | F21K 9/00 362/294 |
| 7,824,076 | B2 * | 11/2010 | Koester | F21V 13/10 362/294 |

(Continued)

FOREIGN PATENT DOCUMENTS

| | | | |
|---|---|---|---|
| DE | 202017107740 | U1 | 1/2018 |
| WO | 2016156463 | A1 | 10/2016 |

*Primary Examiner* — Laura K Tso

(74) *Attorney, Agent, or Firm* — Volpe and Koenig, P.C.

(57) ABSTRACT

A lighting module comprises a heat sink with a body portion and a protrusion portion protruding from the body portion into a forward direction. An LED element is mounted on a mounting surface of the protrusion portion. The mounting surface is arranged facing partially backwards and forming an angle of 5-45° to the forward direction. An electrical plug connector is provided within the body portion's cavity and is electrically connected to the LED element. In the lighting system, a reflector assembly comprises a concave reflector with an inner reflector space. A lighting module is arranged such that its protrusion portion projects into the inner reflector space. Light emitted from the LED element is reflected by the reflector. The body portion is arranged outside of the reflector space. The lighting module may be replaced by separating the lighting module from the reflector assembly and providing a new lighting module.

15 Claims, 10 Drawing Sheets

(56) References Cited

U.S. PATENT DOCUMENTS

| | | | | |
|---|---|---|---|---|
| 8,919,994 | B2 * | 12/2014 | Wimberly | F21V 13/04 362/232 |
| 9,310,057 | B2 * | 4/2016 | Helbig | F21S 41/192 |
| 2003/0063476 | A1 * | 4/2003 | English | B60Q 1/2696 362/545 |
| 2014/0029283 | A1 * | 1/2014 | Boyd, Jr. | F21S 43/14 362/511 |

* cited by examiner

LIGHTING MODULE WITH INCLINED LED MOUNTING SURFACE

FIELD OF INVENTION

The invention relates to a lighting module, a lighting system including an exchangeable lighting module and a method of replacing a lighting module. In particular, the invention relates to a lighting module with at least one LED element.

BACKGROUND

LED elements are increasingly used for lighting applications, such as for example automotive lighting.

While in many applications LED elements are fixed within a lighting system, such as e.g. an automotive headlight, exchangeable LED lighting modules have already been proposed.

DE 20 2017 107 740 U1 discloses an LED module with a heat sink and LED elements which are arranged opposite to each other on angular faces. The LEDs are arranged inside a light housing.

WO 2016/156463 A1 describes a LED module with a LED arrangement mounted on a first heat sink portion, which constitutes a first part of a multiple part heat sink. The first heat sink portion comprises an outer surface for reception in a corresponding receiving opening of a second heat sink part. In order to change the LED arrangement, the module is changed as a unit by disconnecting a mechanical coupling between the two heat sink parts.

SUMMARY

It may be considered desirable to provide a lighting module, a lighting system and a method of exchanging a lighting module with advantageous optical properties.

This object may be addressed by a lighting module according to claim 1, a lighting system according to claim 13 and a method according to claim 15. Dependent claims relate to preferred embodiments of the invention.

According to examples in accordance with an aspect of the invention, a lighting module comprises

- a heat sink with a body portion and a protrusion portion protruding from the body portion into a forward direction,
- and at least one LED element mounted on a mounting surface of the protrusion portion,
- wherein the mounting surface is arranged facing partially backwards and forming an angle of 5-45° to the forward direction
- and at least one electrical plug connector provided at said body portion,
- wherein said LED element is electrically connected to said electrical plug connector,
- and wherein said electrical plug connector is provided within a cavity of said body portion.

The LED element may comprise one or more LEDs, which is used here to designate any type of solid state lighting element, including light emitting diodes, laser diodes organic light emitting diodes etc. While the LED element may comprise packaged LEDs, it is preferred that one or more bare dies may be mounted on a carrier, preferably a flat carrier, such as e.g. a ceramic carrier which may be directly attached to the mounting surface of the heat sink. Both the carrier and the mounting surface are preferably plane.

The heat sink should be made out of a material with good heat conduction, preferably metal, in particular comprising aluminum and/or copper. The heat sink may be made in one piece, or may comprise several pieces joined together. Preferably, the body portion and the protrusion portion may be formed in one piece. The body portion is preferably larger than the protrusion portion, i.e. has a higher volume and/or extension perpendicular to the forward direction. In particular, heat fins may be provided on the body portion to dissipate heat.

The forward direction is defined by the direction into which the protrusion portion protrudes. In preferred examples, the forward direction may coincide with a longitudinal axis of the protrusion portion. According to an aspect of the invention, at least one mounting surface on the protrusion portion is arranged to face partially backwards, forming an angle of 5-45°, preferably at least 10°, further preferred 10-30° to the forward direction. The arrangement of the mounting surface facing partially backwards should be understood as referring to the normal vector thereof, which extends perpendicularly from the mounting surface. Under the preferred arrangement, this normal vector (which in the preferred case of the LED element being arranged in parallel to the mounting surface coincides with the main light emission direction thereof) is oriented partially backwards, i.e. has a directional component opposite to the forward direction. This orientation and the angle formed between the forward direction and the extension of the mounting surface allows to achieve an emission of light from the LED element with a central light emission direction not oriented fully or partially in forward direction or perpendicular thereto, but backwards. This orientation may be of particular use in connection with a reflector which at least partially surrounds the protrusion portion, in particular a concave reflector. By providing light emitted partially backwards, portions of the reflector surface arranged behind the LED element may be efficiently used to form an emitted beam by reflection. The arrangement of the mounting surface on the protrusion portion may preferably be such that a distance between the mounting surface and an axis extending in the forward direction increases with increasing distance from the main body portion. The mounting surface may thus be arranged inclined relative to the forward direction.

According to the invention, the lighting module may comprise an electrical plug connector, arranged at the body portion. The electrical plug connector is integrated into the heat sink and, according to the invention, arranged within a cavity of the body portion. The electrical plug connector may consist of a plug housing comprising electrical contact tabs protruding into the plug housing. Due to the electrical plug connector, the lighting module may be easily and directly connected to an external power supply. The plug housing may preferably be integrated completely into the cavity such that the dimensions of the lighting module may be unmodified by the plug connector. Thus, a compact and space-saving integration of the electrical plug connector may be achieved.

The LED element is electrically connected to the electrical plug connector by one or more electrical conductors. Therefore, the electrical conductors may extend from the electrical plug connector to the LED element, e.g. on the surface of the body portion and/or protrusion portion of the heat sink.

In a preferred embodiment, the LED element is electrically connected to the electrical plug connector via an electrical connection through a cavity inside the heat sink.

The electrical connection passes through the body portion and/or the protrusion portion. The electrical connection being mainly inside the lighting module may be protected from environmental influences such as mechanical stress or humidity. The electrical connection may comprise a lead frame, preferably with a plurality of flat conductor elements. The electrical connection may be electrically insulated from the heat sink. Therefore, it may be embedded in plastic material. In preferred embodiments, the heat sink may comprise at least one cavity filled with an electrically insulating material, such as a plastic material, embedding one or more electrical connectors.

At least parts of the lighting module may be provided with a housing or overcoat, in particular made of plastic material. A window or cutout may be formed for the LED element, which should advantageously be mounted directly on the heat sink. According to a preferred embodiment, a plug housing of the electrical plug connector may be formed in one piece with an overcoat provided on the heat sink. The overcoat may be made e.g. of any plastic material which is thermally conductive and/or electrically isolating. In order to build an electrical plug connector, the plug housing may provide openings such that the electrical connection may extend into the plug housing. The plug housing may be manufactured in one step with the overcoat which may facilitate to manufacture the lighting module comprising the electrical plug connector. Furthermore, the design may be mechanically more stable than a combination of an overcoat with an individually formed plug housing due to the transition between the different elements.

In preferred embodiments, the lighting module may comprise more than one mounting surface and LED element mounted thereto. The different mounting surfaces may face into parallel directions or into different directions. One or more mounting surfaces may be provided on the body portion and/or on the protrusion portion. According to one preferred embodiment, the protrusion portion may have a top surface and opposite bottom surface, which should be understood by reference to a horizontal orientation of the forward direction. A first LED element may be mounted on a first mounting surface on the top surface of the protrusion portion and a second LED element on the second mounting surface on the bottom surface of the protrusion portion. In particular, the first and second LED element may be mounted directly opposite to each other, e.g. in mirrored configuration. Same as the first mounting surface, also the second mounting surface may preferably be arranged facing partially backwards under an angle of 5-45°, preferably at least 10°, further preferred 10-30° to the forward direction.

If more than one mounting surface and corresponding LED element are provided, it is preferred that the LED elements are separately electrically connected, such that they may be operated independently of one another. By selectively operating the first and/or second LED element, different resulting beams with different spatial light distributions may be emitted from the lighting module, allowing e.g. emission of a low beam, high beam, fog beam etc. from a vehicle headlight comprising the lighting module.

In preferred embodiments, at least one recess may be formed in the protrusion portion. The recess may be of different shape, e.g. as a groove or any shape of hole, indentation etc. Especially preferred is a recess with at least one plane wall, e.g. a V-shaped groove. The mounting surface may be provided at least partially, preferably fully within the recess. In the case of more than one mounting surface provided on the protrusion portion, it is further preferred to provide two separate recesses, preferably on opposite surfaces, and further preferred directly opposite to each other, e.g. in mirrored configuration.

According to a preferred embodiment, the body portion of the heat sink may comprise a plate member, i.e. a flat element with preferably rectangular shape. Preferably, the body portion may terminate towards the forward direction in a plate member. The protrusion portion may project from the plate member, in particular from a center portion of the plate member. Preferably, the protrusion portion may protrude rectangularly from the plate member. Heat fins may protrude from the plate member in backwards direction.

The LED element preferably has at least one electrical contact portion on a top surface, i.e. facing into the light emission direction. Preferably, two contact surfaces may be formed on the top surface, electrically connected to the two terminals of one or more LEDs on the LED element. An electrical connection to these contact portions may be made e.g. by wire bonding or ribbon bonding. The connection may be potted, i.e. fully or partially embedded in an electrically non-conductive material such as e.g. silicone.

In a preferred embodiment, the lighting module comprises electrical connection pads that are arranged within one plane with the electrical contact portions. The electrical connection pads may be electrically connected with the electrical contact portions. Also, the electrical connection pads may be connected with the electrical plug connector, e.g. via the electrical connection. The electrical connection pads may be arranged adjacent to the electrical contact portions. The electrical connection pads and electrical contact portions may be electrically connected by e.g. ribbon bonds or other connection technologies. Thus, the electrical connection between the electrical connection pads and the electrical contact portions may be implemented on the top surface facing in the same direction as the emitted light beam. Therefore, the LED element is connected to the electrical plug connector via the electrical contact portions, the electrical connection pads and the electrical connection. According to this embodiment, the arrangement of electrical connection pads and electrical contact portions may facilitate electrically connecting the LED element to the lighting module.

According to one embodiment, the lighting module may comprise at least one alignment protrusion or alignment indentation. These may be used to ensure exact positioning of the lighting module within a lighting system, e.g. relative to a reflector assembly. One or more alignment protrusions/indentations may be provided on the body portion and/or on the protrusion portion. In preferred embodiments one or more of the alignment protrusions or indentations may be formed in a housing or plastic overcoat of the heat sink.

According to one aspect of the invention, a lighting system comprises a reflector assembly and a lighting module. The reflector assembly may comprise at least one concave reflector with an inner reflector space. The lighting module may be exchangeably mounted to the reflector assembly. In the mounting position of the lighting module, the protrusion portion projects into the inner reflector space, such that light emitted from the LED element of the lighting module is reflected by the reflector. The body portion of the heat sink of the lighting module may be arranged outside of the reflector space, so that heat can be efficiently dissipated. The lighting system may be an automotive headlight.

In the mounted position of the lighting module within the lighting system, at least one reflector assembly alignment protrusion or indentation may engage at least one module alignment protrusion or indentation, e.g. such that a module alignment protrusion is received within a reflector assembly alignment indentation, and/or a reflector alignment protrusion is received within a module alignment indentation. This ensures exact positioning of the lighting module, and in particular of the LED element, relative to the reflector assembly.

According to one aspect of the invention, a lighting module of a lighting system may be replaced. According to the method of claim 15, the lighting module may be separated from the reflector assembly and a new lighting module may be arranged in its place. Preferably, the new lighting module is of identical shape and construction to the replaced lighting module. In particular, it is preferred that the lighting modules have alignment protrusions or indentations, and that the position of the LED element relative to the module alignment protrusions or indentations is identical for both the old and the new lighting module.

To facilitate the replacement, the lighting module and/or the reflector assembly may have mechanical mounting elements for exchangeably fixing the lighting module to the reflector assembly. This may include any type of mounting means, such as e.g. clamping means, bayonet connection, snap-in connection etc. Further, the method preferably includes electrically disconnecting the lighting module before replacement and electrically connecting the new lighting module, preferably by an electrical plug connection.

These and other aspects of the invention will be apparent from and elucidated with reference to the embodiments described hereinafter.

DETAILED DESCRIPTION OF THE PREFERRED EMBODIMENTS

Figure 1:
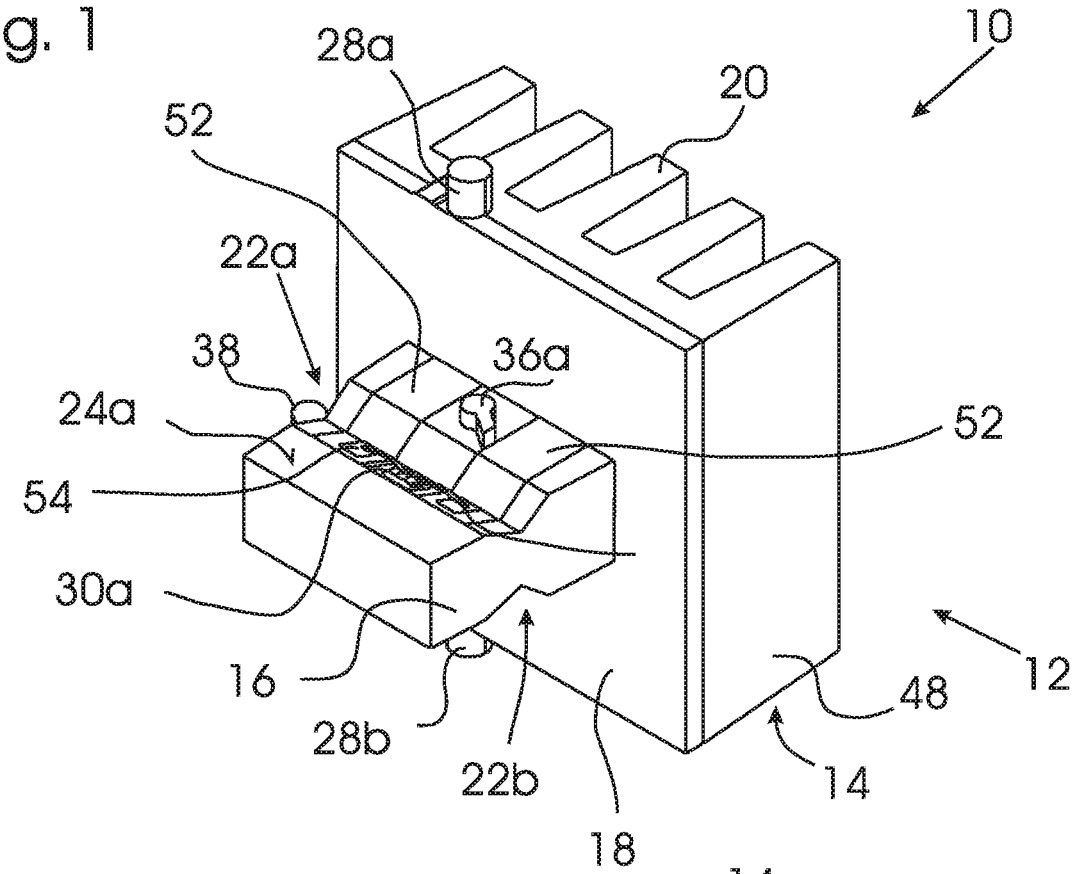
FIG. 1 shows a perspective view of an embodiment of a lighting module.

An embodiment of an LED lighting module 10 is shown in FIG. 1-8. The lighting module 10 includes a heat sink 12 comprised of a body portion 14 and a protrusion portion 16.

The body portion 14 is comprised of a rectangular plate 18 from which the protrusion portion 16 protrudes into a forward direction F (designated in FIG. 2) and which has heat fins 20 extending in backward direction.

The heat sink 12 is made of a metal heat sink material with good heat conducting properties, in particular of Aluminum. In the preferred embodiment, the body portion 14 and protrusion portion 16 are formed in one piece, although in alternative embodiments the parts forming the heat fins 20, plate 18 and protrusion portion 16 may be separate parts fixed to each other.

The protrusion portion 16 protrudes from a center portion of the plate 18. The forward direction F is perpendicular to the forward surface of the plate 18. In the example shown, the protrusion portion 16 has rectangular cross-section. Further, in the preferred example as shown the central longitudinal axis X of the protrusion portion 16 extends in parallel with the forward direction F.

A recess 22*a* in the shape of a V-shaped groove is formed in an upper surface 24*a* of the protrusion portion 16. A further recess 22*b* is provided in the lower surface 24*b* of the protrusion portion 16 in mirrored configuration.

A first mounting surface 26*a* is provided on the upper surface 24*a*, within the groove 22*a*, and a second mounting surface 26*b* is provided on the lower surface 24*b* within the groove 22*b*. A first and a second LED element 30*a*, 30*b* are attached on the respective first and second mounting surfaces 26*a*, 26*b*.

Figure 3:
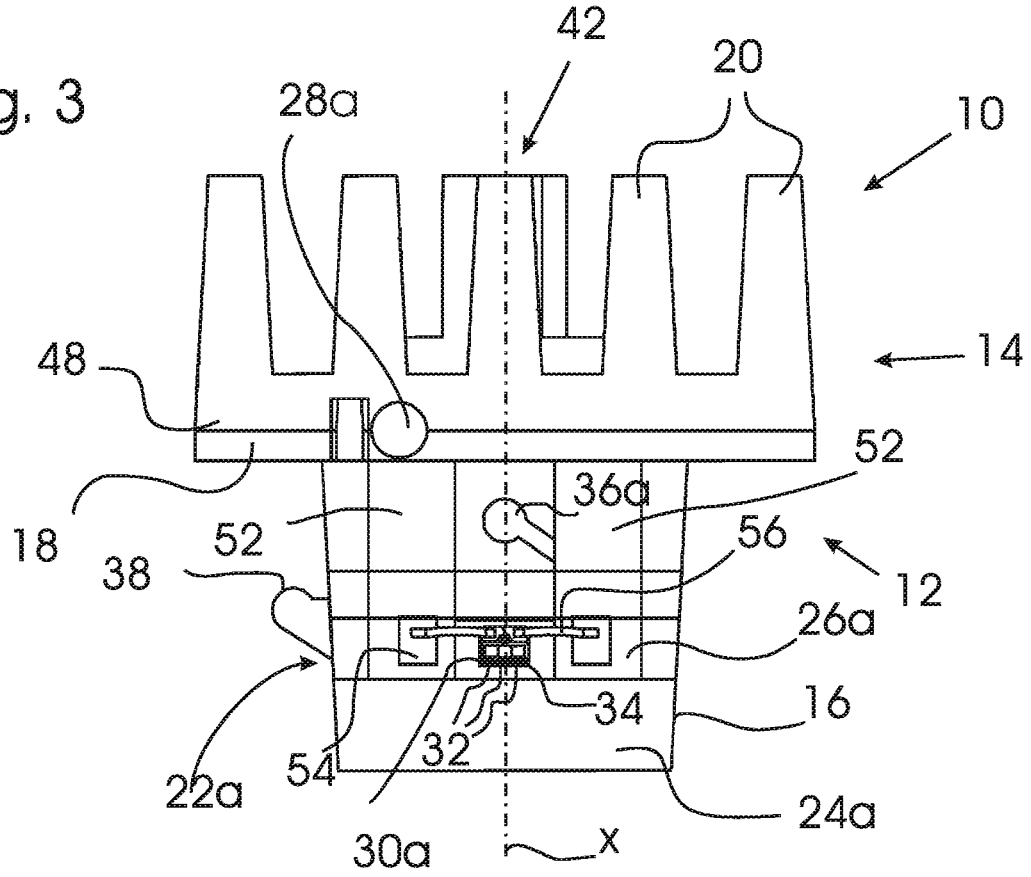
FIG. 3 shows a top view of the lighting module of FIGS. 1 and 2.
Figure 4:
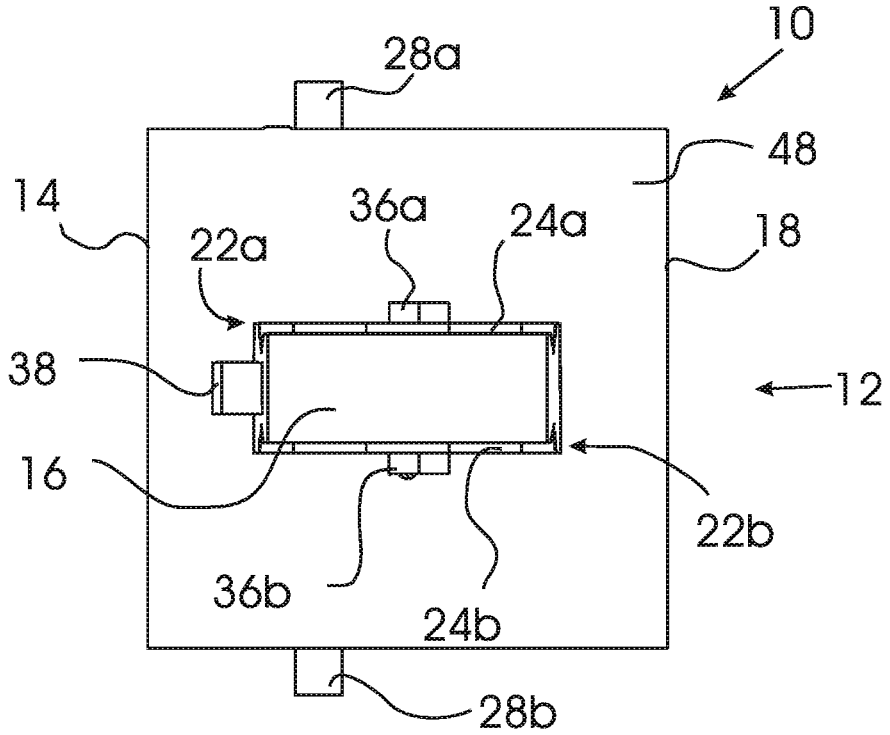
FIGS. 4 and 5 show a front and a back view of the lighting module of FIGS. 1-3.
Figure 5:
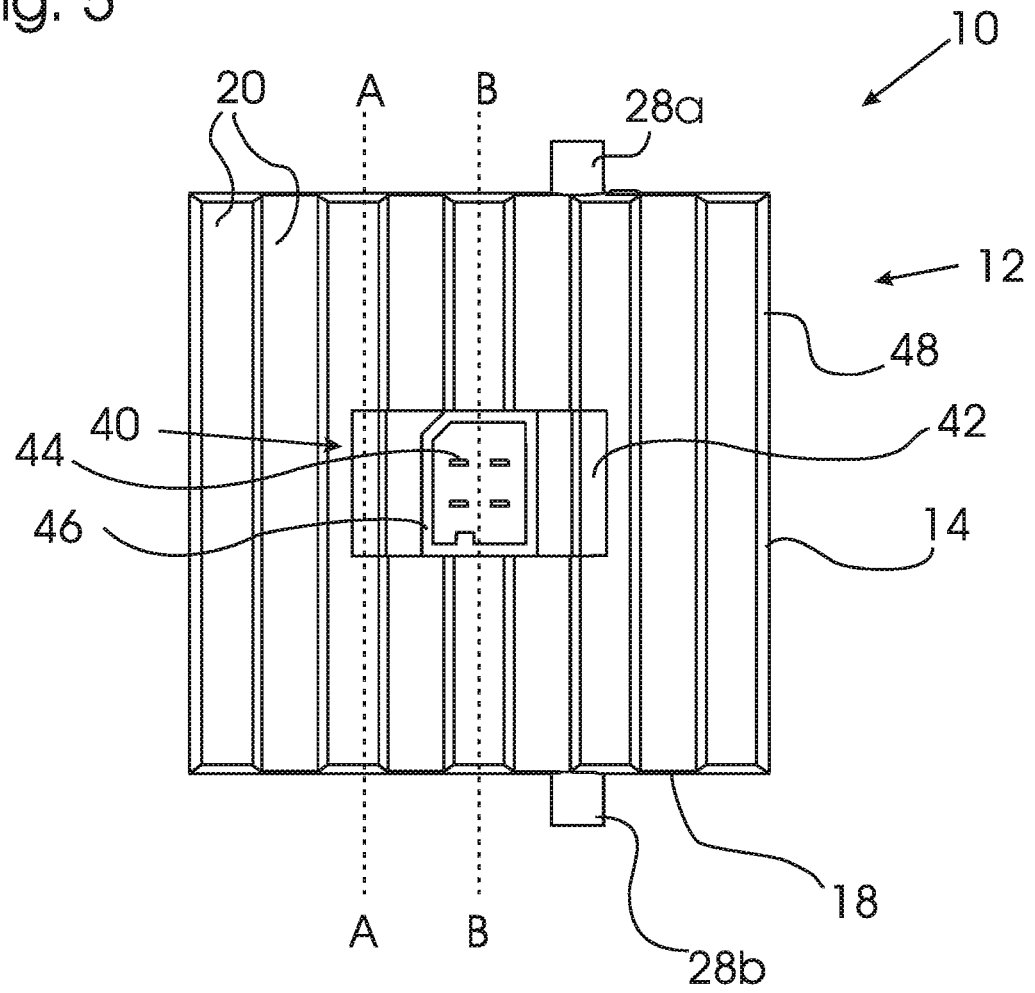
Figure 6:
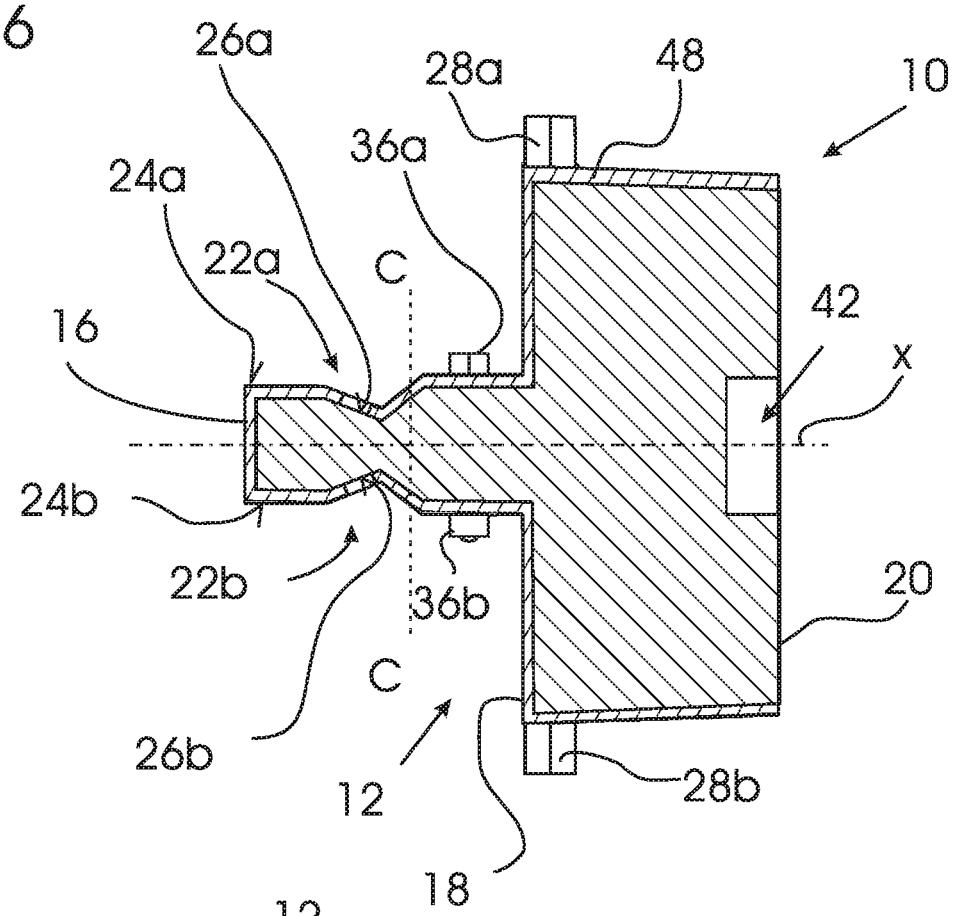
FIG. 6 shows a sectional view of the lighting module of FIGS. 1-5 with the section taken along line A . . . A in FIG. 5.
Figure 7:
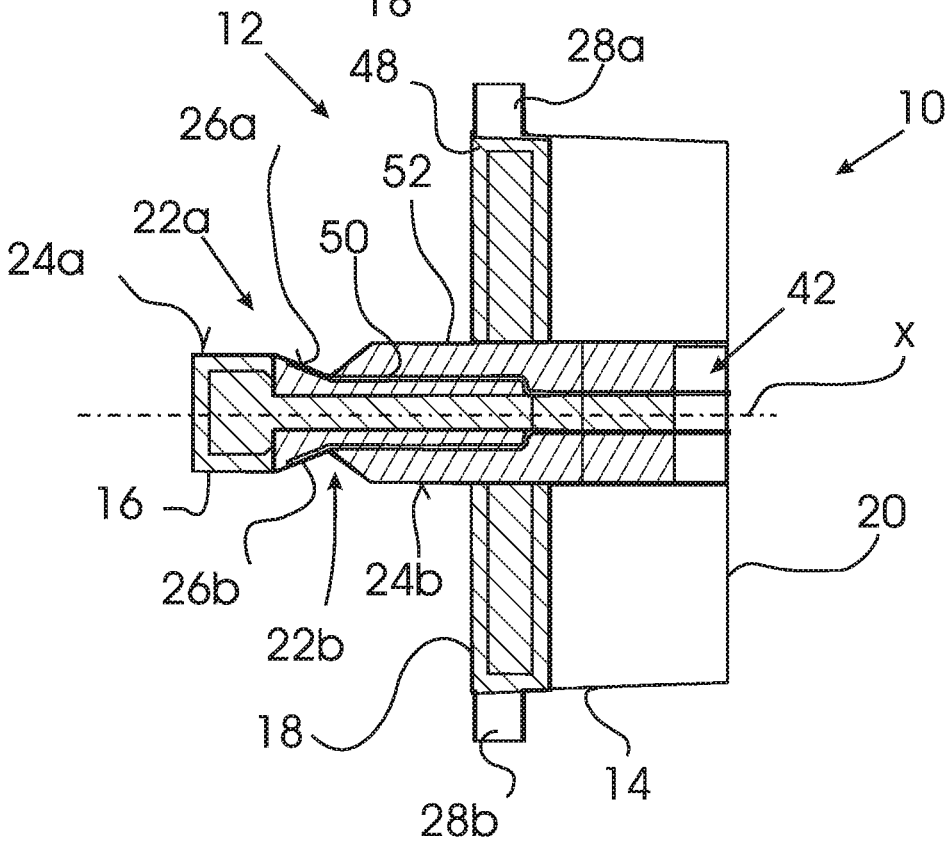
FIG. 7 shows a sectional view of the lighting module of FIGS. 1-5 with the section taken along line B . . . B in FIG. 5.
Figure 8:
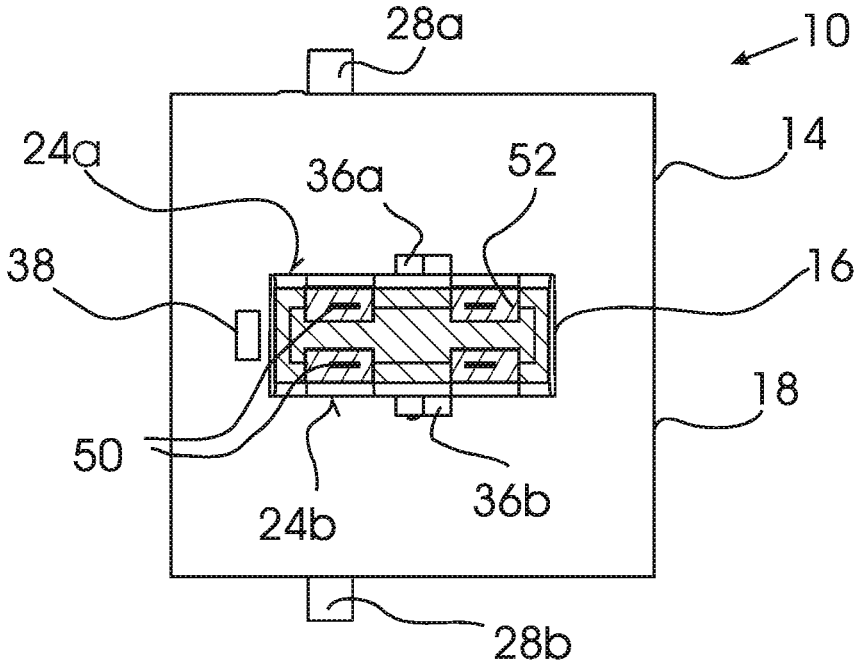
FIG. 8 shows a sectional view of the lighting module of FIGS. 1-7 with the section taken along the line C . . . C in FIG. 6.

As shown in FIG. 3, each of the LED elements 30*a* comprises a plurality (in the shown example three) bare LED dies 32 provided on a flat rectangular ceramic carrier 34.

Figure 2:
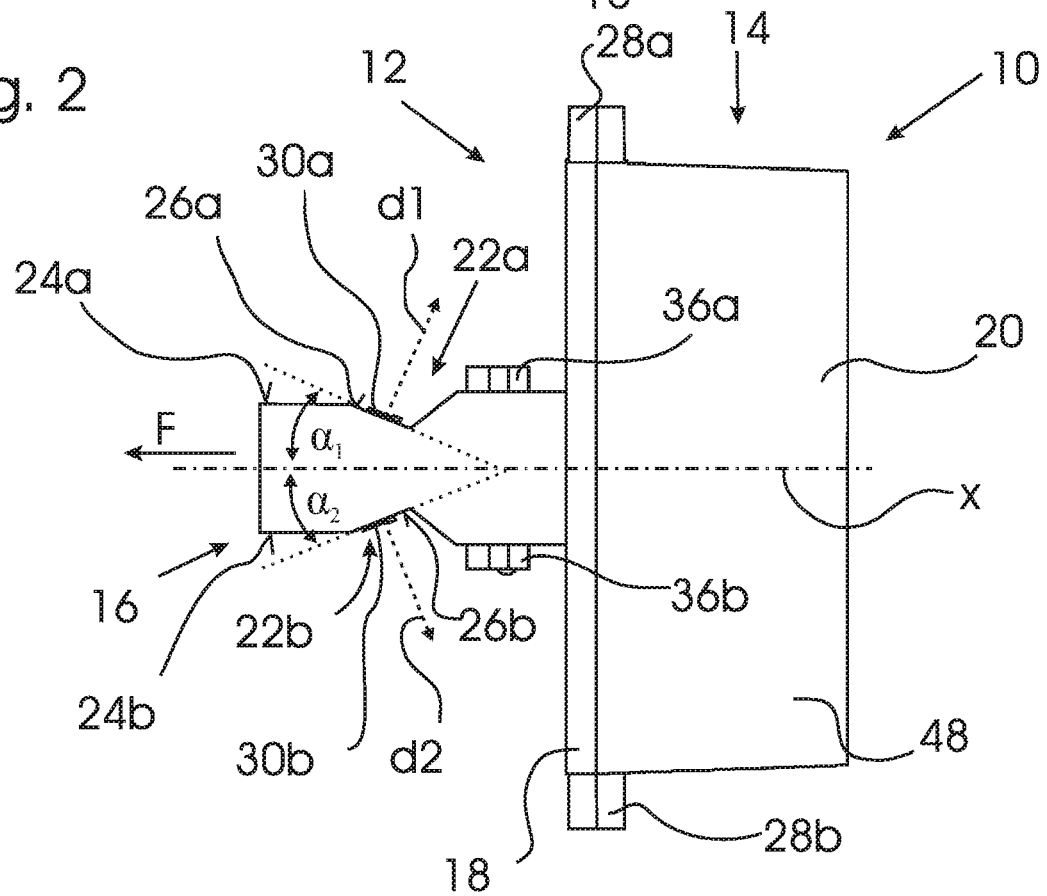
FIG. 2 shows a side view of the lighting module of FIG. 1.

As visible in particular from FIG. 2, the mounting surfaces 26*a*, 26*b* are arranged under angles $\alpha_1$, $\alpha_2$ relative to the forward direction F and the longitudinal axis X. In the example shown, the angles $\alpha_1$, $\alpha_2$ are both at approximately 25°.

In FIG. 2, vectors d1 and d2 designate the normal vectors of the mounting surfaces 26*a*, 26*b*. Since the LED elements 30*a*, 30*b* are flat and provided with LED dies 32 without optics, the vectors d1, d2 constitute the central light emission direction (center of the lambertian light emission characteristics).

As shown in FIG. 2, the direction of the vectors d1, d2 is partially backwards, i.e. the vectors d1, d2 have a directional component opposed to the forward direction F.

The heat sink 12 of the lighting module 10 is provided with a plastic overcoat 48. The overcoat 48 is molded over the metal heat sink. The overcoat 48 has windows or cutouts formed at the mounting surfaces 26*a*, 26*b* to allow directly mounting the LED elements 30*a*, 30*b* onto the metal surface of the heat sink.

The lighting module 10 further has a number of module alignment protrusions: A first set of alignment protrusions 28*a*, 28*b* is provided on the body portion 14 of the heat sink 12, a second set of alignment protrusions 36*a*, 36*b* is provided on the upper and lower surfaces 24*a*, 24*b* of the protrusion portion 16 and a third type of alignment protrusion 38 is provided on a lateral surface of the protrusion portion 16. As will be explained below, the alignment protrusions 28*a*, 28*b*, 36*a*, 36*b*, 38 serve to achieve exact positioning of the lighting module 10 when installed in a lighting system 60. The alignment protrusions 28*a*, 28*b*, 36*a*, 36*b*, 38 are formed as part of the plastic overcoat 48.

The lighting module 10 further comprises an electrical plug connector 40 (see FIG. 5) provided to the back of the body portion 14 of the heat sink 12, integrated within a cut out 42 formed between the heat fins 20. The plug connector 40 comprises electrical contact tabs 44 (two pairs, each pair being connected to two poles of each LED element 30*a*, 30*b*) arranged to protrude into a space surrounded by a plug housing 46. As shown in the sectional views of FIGS. 7, 8, electrical conductors 50 in the form of lead frame elements embedded within a plastic material 52 extend through openings within the plate 18 and through channels within the protrusion portion 16 from the contact tabs 44 to contact pads 54 (FIG. 3) on the mounting surfaces 26*a*, 26*b*.

As further shown in FIG. 3, the LED elements 30*a*, 30*b* are electrically contacted to the contact pads 54 by ribbon bonds 56. The electrical contacts are potted in Silicone for protection.

The lighting module 10 may be operated by connecting a power supply plug to the electrical plug connector 40 and supplying electrical power to the LED elements 30*a*, 30*b* through the conductors 50, contact pads 54 and ribbon bonds 56. The LED elements 30*a*, 30*b* then emit light as lambertian emitters around the central directions d1, d2.

Figure 11:
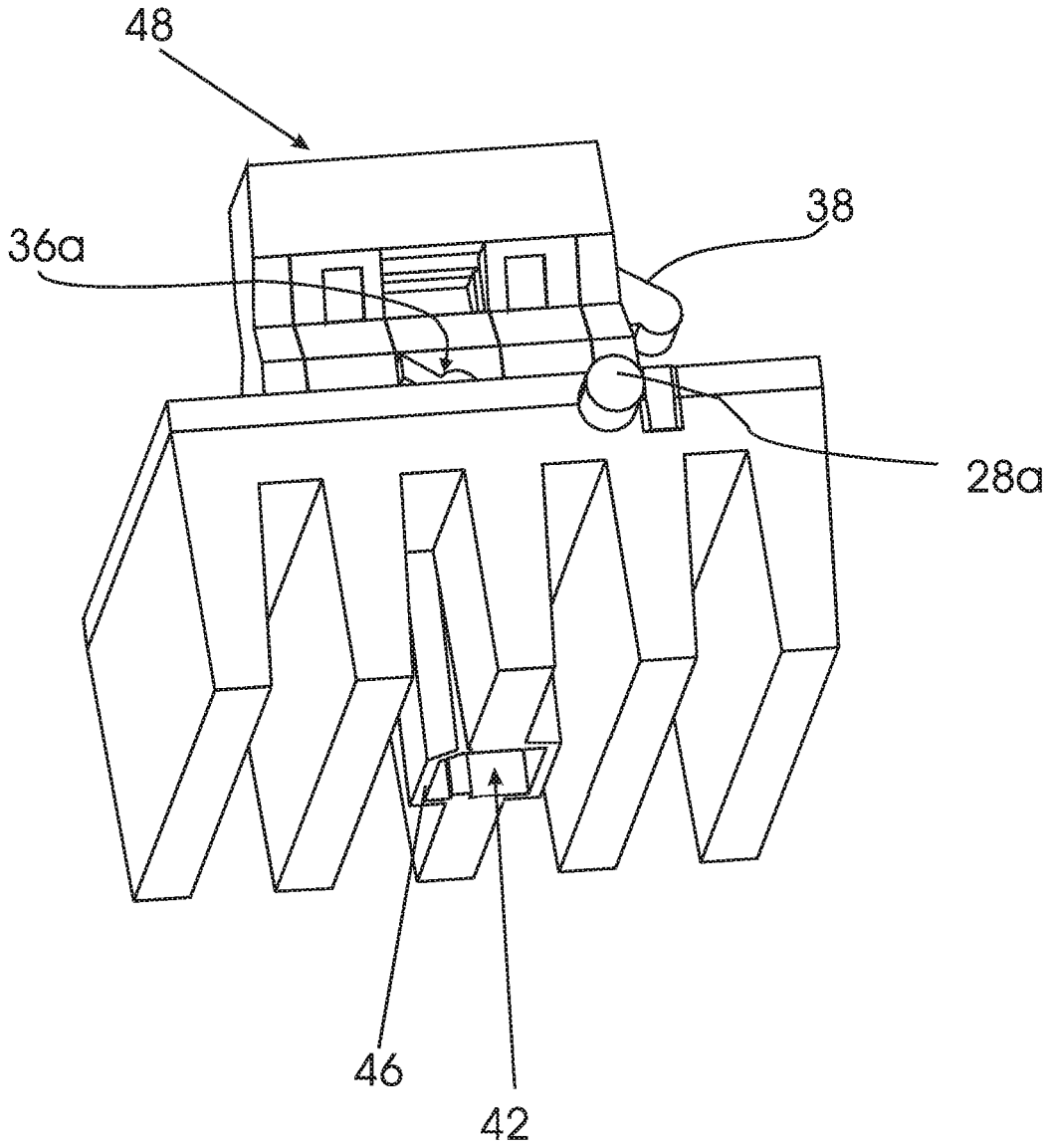
FIG. 11 shows a perspective view of an overcoat and a plug housing of a second embodiment of a lighting module.

According to a second embodiment, the plug housing 46 may be formed together with the overcoat 48. FIG. 11 shows only the overcoat 48 and the plug housing 46 of a lighting module according to the second embodiment (the further elements of the lighting module are not shown in FIG. 11). The overcoat 48 covers the protrusion portion 16 leaving windows 49 for the LED elements 30*a*, 30*b*. Further, alignment protrusions 28*a*, 28*b*, 36*a*, 36*b*, 38 are provided. Furthermore, the overcoat 48 covers the body portion 14 of the heat sink 12 of the lighting module 10. The shape of the bottom part of the overcoat 48 is adapted to the shape of the heat fins 20 such that the heat fins 20 are covered by the overcoat 48. The heat fins 20 of this embodiment are arranged in parallel and one of these heat fins 20 is separated into two parts such that a cavity 42 is formed. Into this cavity 42 of the heat sink 12, the plug housing 46 is arranged. Thus, the plug housing 46 is completely contained inside the cavity 42 and does not protrude from the heat sink 12.

Figure 12:
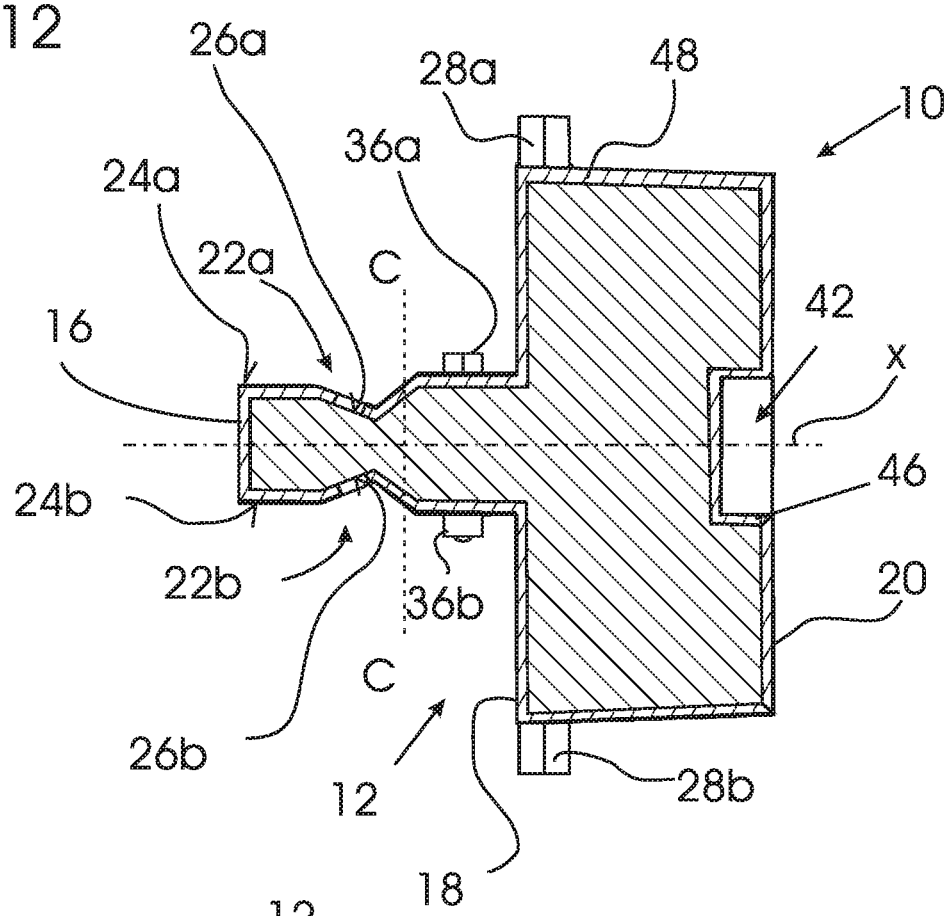
FIGS. 12 and 13 show a sectional view of a lighting module according to the second embodiment of FIG. 11.
Figure 13:
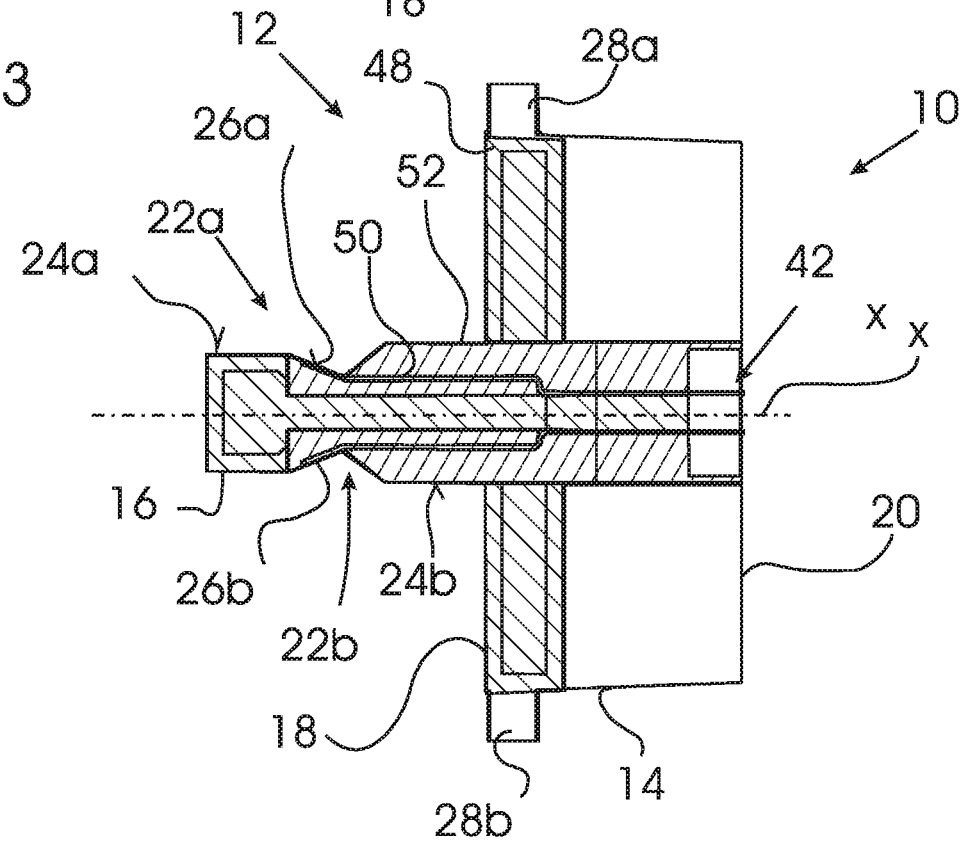

FIG. 12, FIG. 13 show a lighting module 10 of the second embodiment. The lighting module 10 according to the second embodiment corresponds to the lighting module 10 described above except for the overcoat 48 and the plug housing 46. In the second embodiment, the overcoat 48 and the plug housing 46 are formed in one piece.

Figure 9:
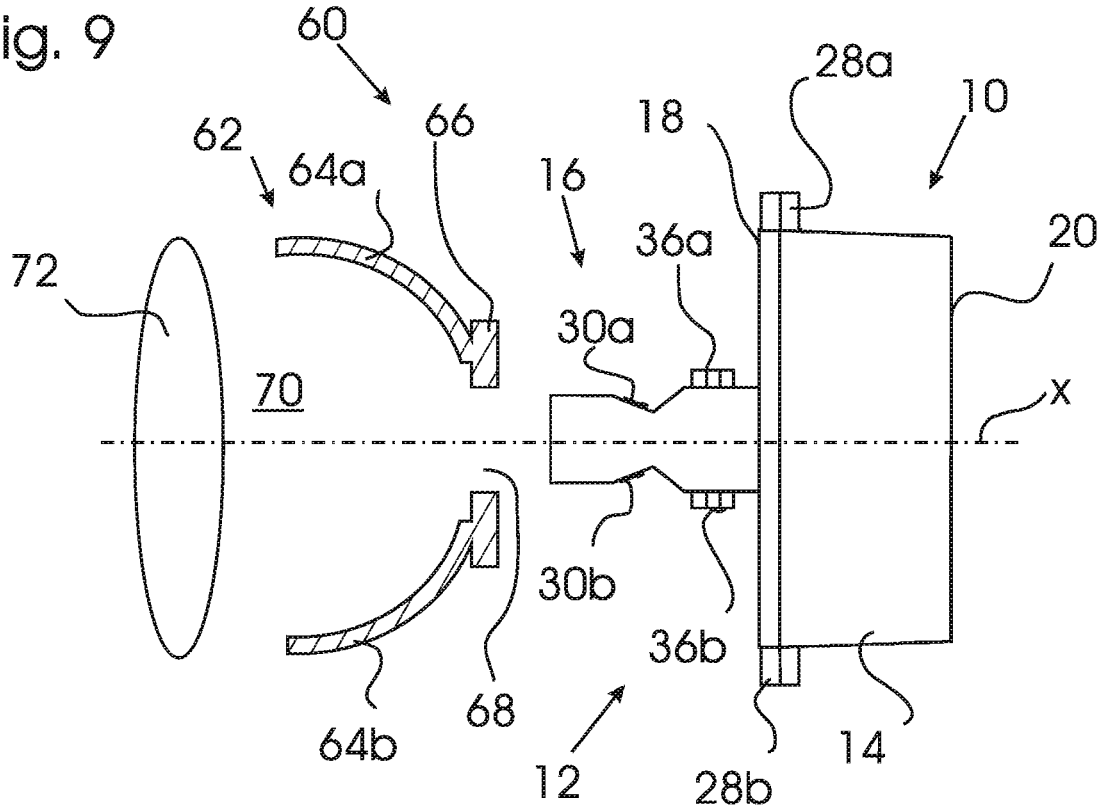
FIG. 9 shows a sectional side view of a lighting system with the lighting module according to FIG. 1-8 in an exploded state.
Figure 10:
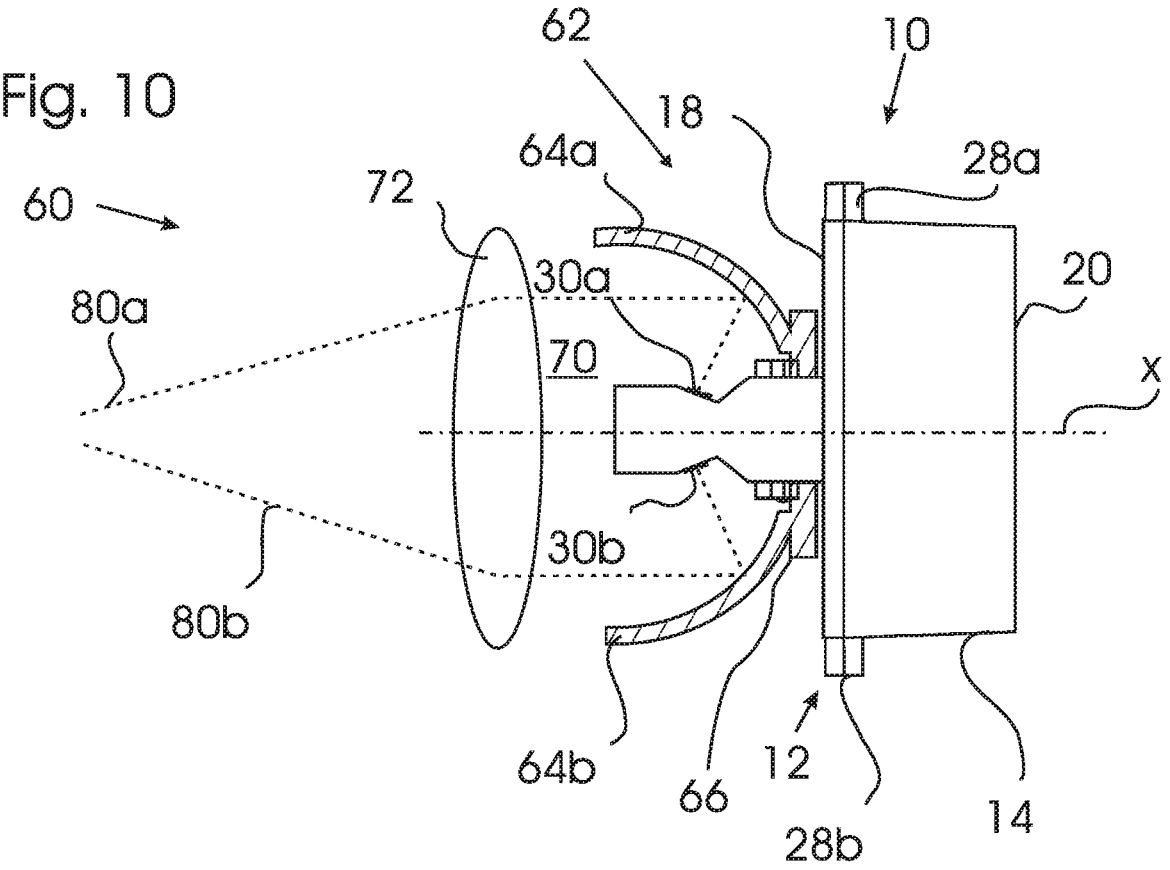
FIG. 10 shows the lighting system of FIG. 9 in an assembled state.

FIG. 9, FIG. 10 show a lighting system 60 including the lighting module 10 described above. In addition to the lighting module 10, the lighting system 60 comprises a reflector assembly 62 including a reflector with an upper reflector part 64*a* and lower reflector part 64*b* and a mounting portion 66 including a mounting opening 68 leading to an inner reflector space 70 partially surrounded by the upper and lower reflector parts 64*a*, 64*b*. Further, the lighting system comprises a lens 72 arranged in front of the reflector assembly 62.

As shown in FIG. 9, the lighting module 10 may be mounted to the reflector assembly 62 by attaching the lighting module 10 to the mounting portion 66 thereof, thereby inserting the protrusion portion 16 through the mounting opening 68 to protrude into the inner reflector space 70.

FIG. 10 shows the lighting module 10 installed within lighting system 60. The lighting module 10 is accurately positioned relative to the reflector assembly 62 such that the LED modules 30*a*, 30*b* are arranged at a specified, known position within the reflector space 70. Exact positioning is achieved by the positioning protrusions 28*a*, 28*b*, 36*a*, 36*b* and 38, which are received in corresponding reflector assembly alignment indentations (not shown in FIGS. 9 and 10).

Further, the lighting module 10 is fixed to the reflector assembly 62 by clamping (not shown).

Thus, the lighting module 10 is attached exchangeably at the reflector assembly 62. The lighting module 10 may be exchanged by disconnecting an electrical plug connection (not shown), loosening the mechanical clamping connecting (not shown in FIGS. 9, 10) and then withdrawing the lighting module 10 from the reflector assembly 62 by backward movement along the axis X. Likewise, a replacement lighting module 10 may be installed, replacing the previous lighting module 10.

FIG. 10 shows the arrangement of the LED elements 30*a*, 30*b* within the reflector space 70. Due to the partially backwards facing orientation of the LED elements 30*a*, 30*b*, the inner reflector surfaces of upper and lower reflector parts 64*a*, 64*b* are well illuminated and reflect the emitted light to form a first beam 80*a* and a second beam 80*b* which are projected by projection lens 72 as emitted beams.

The LED elements 30*a*, 30*b* thus illuminate separate portions 64*a*, 64*b* of the reflector assembly 62. The shape of the reflector parts 64*a*, 64*b* may be chosen to obtain, in conjunction with the projection lens 72, desired light distributions of resulting beams 80*a*, 80*b*.

Figure 14:
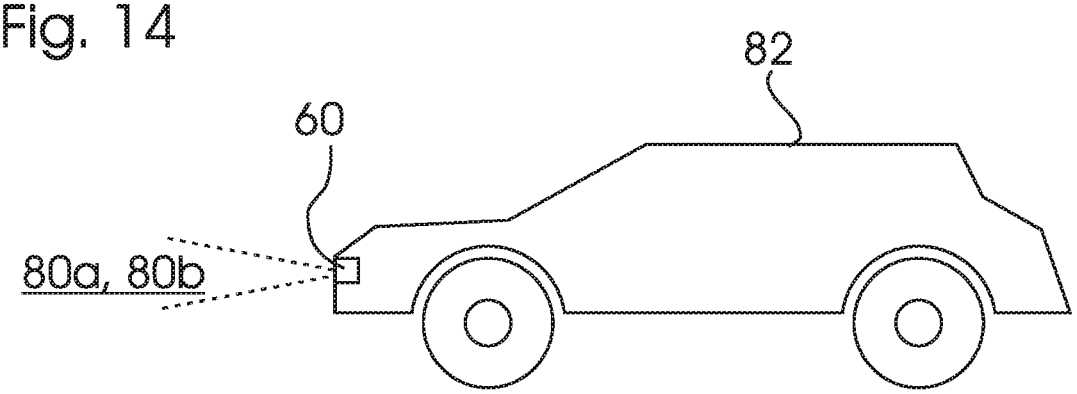
FIG. 14 schematically shows a motor vehicle with a lighting system according to FIGS. 9 and 10 as headlight.

For example, the lighting system 60 may form a headlight of a motor vehicle 82 as schematically shown in FIG. 14. The first emitted beam 80*a*, generated from light emitted from the first LED element 30*a*, may e.g. be a low beam, whereas the second beam 80*b*, informed from light emitted from the second LED element 30*b*, may e.g. be a high beam. Naturally, different beam patterns and combinations thereof are possible.

Figure 15A:
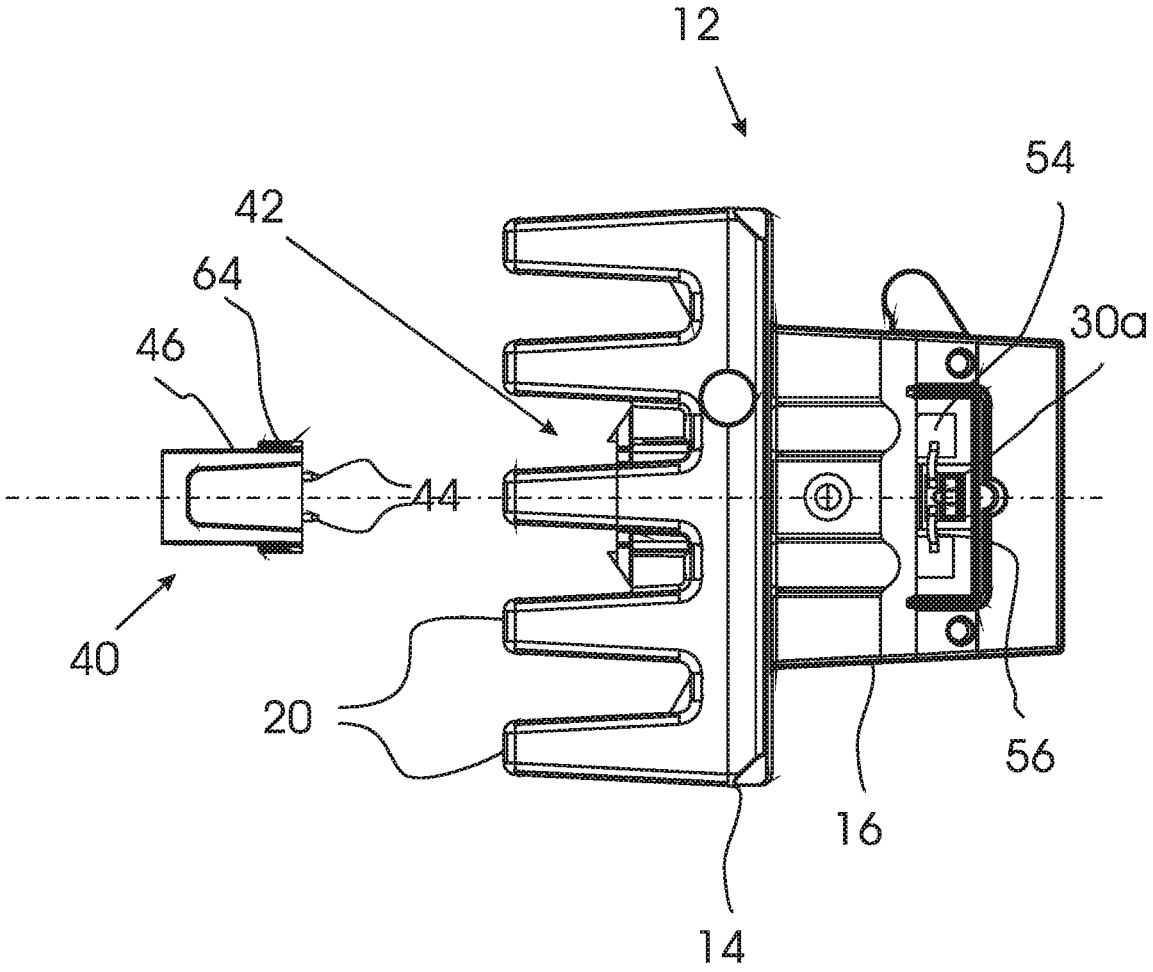
FIG. 15 a shows an exploded top view of a lighting module according to a third embodiment.
FIG. 15*b* shows an exploded back view of the lighting module according to the third embodiment.
Figure 15B:
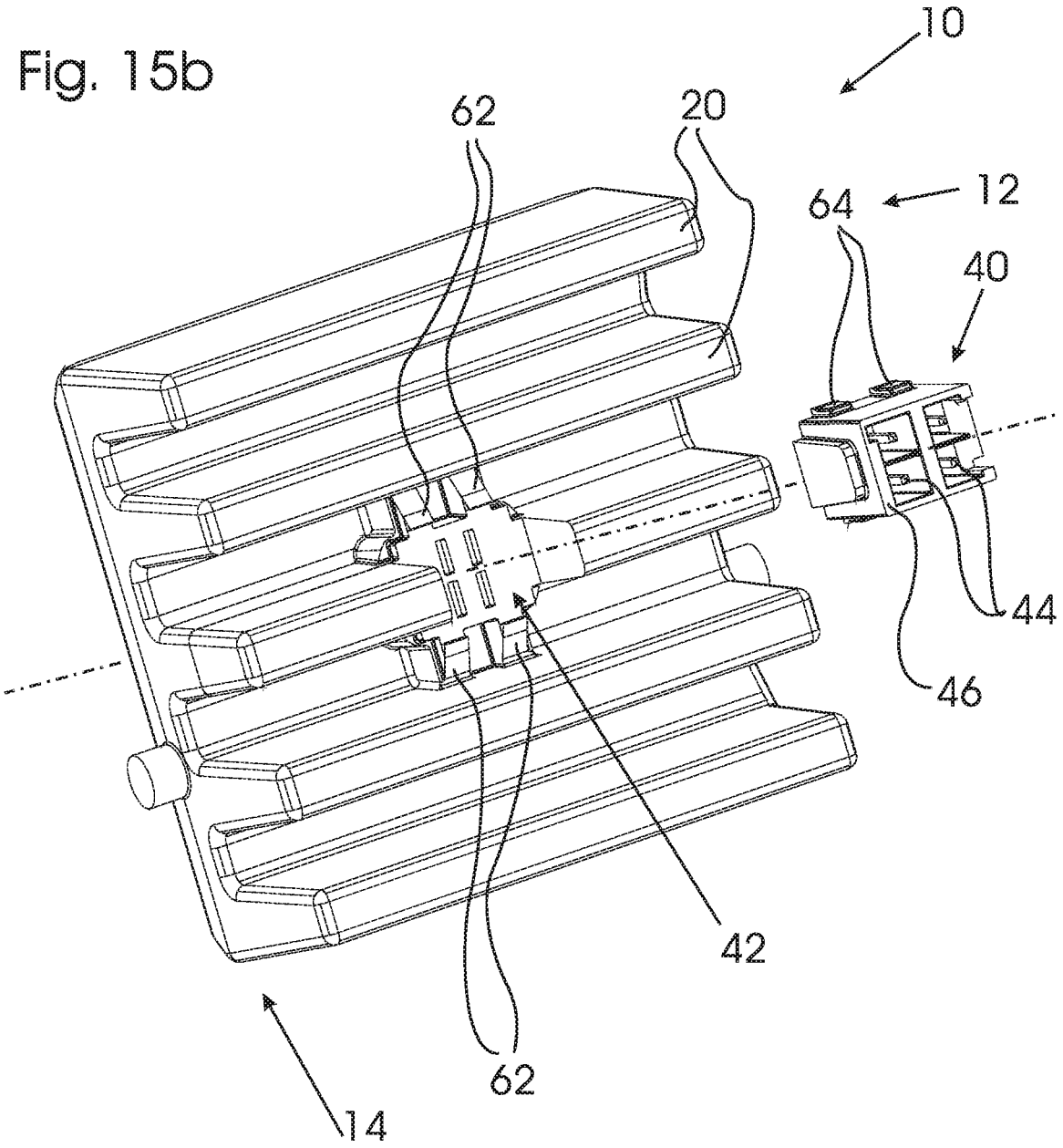

According to a third embodiment, FIGS. 15*a* and 15*b* show exploded drawings of a lighting module according to the third embodiment which corresponds to the lighting module 10 according to the first embodiment. In the following, only differences between the first and the third embodiment will be described. The same reference signs refer to the same elements.

The lighting module according to this embodiment comprises a body portion 14 with heat fins 20. Within the heat fins 20, a cut out 42 is formed. Inside the cut out 42 is an electrical plug connector 40 which is provided as a discrete element. The electrical plug connector 40 comprises a plug housing 46 with two pairs of lugs 64 at opposite sides, and two pairs of electrical contact tabs 44. The electrical contact tabs 44 are electrically connected to an internal electrical connection in order to provide electrical power to LED elements 30*a*, 30*b*. The plug housing 46 and the cut out 42 are shaped, such that the plug housing 46 fits into the cut out 42 and is held by clamp fasteners 62 that engage the lugs 64.

While the invention has been illustrated and described in detail in the drawings and foregoing description, such illustration and description are to be considered illustrative or exemplary and not restrictive; the invention is not limited to the disclosed embodiments.

In particular, the specific shape of the lighting module 10 with a rectangular plate 18 and a protrusion portion 16 with rectangular cross-section should be considered exemplary; different shapes are possible. Further, in alternative embodiments the mounting surfaces 26*a*, 26*b* may be arranged under different angles $\alpha_1$, $\alpha_2$. The shape of the reflector surfaces of the reflector assembly 62 may be chosen differently, such as suitable for a desired beam shape.

These and other variations of the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality.

The mere fact that certain measures or features are recited in mutually different dependent claims or disclosed in separate embodiments does not indicate that a combination of these measures and features cannot be used to advantage. Any reference signs in the claims should not be construed as limiting the scope.

What is claimed is:

1. A lighting module, comprising a heat sink comprising:

a body portion comprising a front surface and a back surface, a cavity being formed in the back surface of the body portion and extending toward the front surface, and a protrusion portion protruding from the front surface of the body portion into a forward direction;

at least one LED element mounted on a mounting surface of the protrusion portion, wherein the mounting surface is arranged facing at least partially backwards and forming an angle of 5-45° to said forward direction; and at least one electrical plug connector provided within the cavity of the body portion, wherein the at least one LED element is electrically connected to the electrical plug connector.

2. The lighting module according to claim 1, wherein:

the at least one LED element is electrically connected to the electrical plug connector via at least one electrical connection through a cavity inside the heat sink, and the electrical connection passes through at least one of the body portion and the protrusion portion.

3. The lighting module according to one claim 1, wherein a plug housing of the electrical plug connector is formed in one piece with an overcoat the heat sink.

4. The lighting module according to claim 1, wherein:

the LED element is a first LED element and the mounting surface is a first mounting surface, the first mounting surface is arranged on a top surface of the protrusion portion, a second mounting surface is arranged on a bottom surface of the protrusion portion, opposite to the top surface, and the at least one second LED element is mounted on the second mounting surface.

5. The lighting module according to claim 1, wherein the mounting surface is arranged such that a distance between the mounting surface and an axis extending in the forward direction increases with increasing distance from the body portion.

6. The lighting module according to claim 1, wherein the protrusion portion of the heat sink is formed in one piece with the body portion.

7. The lighting module according to claim 1, wherein the back surface of the body portion comprises heat fins.

8. The lighting module according to claim 1, further comprising:

a recess formed within the protrusion portion, the mounting surface being provided at least partially within the recess.

9. The lighting module according to claim 1, wherein:

the body portion comprises a plate member, and the protrusion portion project from the plate member.

10. The lighting module according to claim 1, wherein the at least one LED element comprises electrical contact portions on a top surface thereof.

11. The lighting module according to claim 10, further comprising:

electrical connection pads arranged within one plane with the electrical contact portions, the electrical connection pads being electrically connected with the electrical contact portions and with the electrical plug connector.

12. The lighting module according to claim 1, wherein at least one alignment protrusion or indentation is provided on at least one of the body portion and the protrusion portion.

13. A lighting system, comprising:

a reflector assembly comprising at least a concave reflector with an inner reflector space; and a lighting module exchangeably mounted to said reflector assembly including:

a heat sink comprising:

a body portion comprising a front surface and a back surface, a cavity being formed in the back surface of the body portion and extending toward the front surface, and a protrusion portion protruding from the front surface of the body portion into a forward direction, at least one LED element mounted on a mounting surface of the protrusion portion, wherein the mounting surface is arranged facing at least partially backwards and forming an angle of 5-45° to the forward direction, and at least one electrical plug connector provided within the cavity of the body portion, wherein the at least one LED element is electrically connected to the electrical plug connector, the lighting module being arranged such that the protrusion portion projects into the inner reflector space, the at least one LED element being arranged such that light emitted therefrom is reflected by the reflector, and wherein the body portion is arranged outside of the reflector space.

14. The lighting system according to claim 13, wherein:

the reflector further comprises at least one reflector assembly alignment protrusion or indentation, and the lighting module further comprises at least one module alignment protrusion or indentation, and the module alignment protrusion is received within at least one of the reflector assembly alignment indentation and the module alignment indentation.

15. A method of replacing a lighting module of a lighting system, comprising:

separating the lighting module from a reflector assembly, the reflector assembly including at least a concave reflector with an inner reflector space, and the lighting module exchangeably mounted to the reflector assembly and including:

a heat sink comprising:

a body portion comprising a front surface and a back surface, a cavity being formed in the back surface of the body portion and extending toward the front surface, and a protrusion portion protruding from the front surface of the body portion into a forward direction, at least one LED element mounted on a mounting surface of the protrusion portion, wherein the mounting surface is arranged facing at least partially backwards and forming an angle of 5-45° to the forward direction, and at least one electrical plug connector provided within the cavity of the body portion, wherein the at least one LED element is electrically connected to the electrical plug connector, and wherein the body portion is arranged outside of the reflector space;

providing a new lighting module; and arranging the new lighting module such that the protrusion portion projects into the inner reflector space, the at least one LED element being arranged such that light emitted therefrom is reflected by the reflector.

* * * * *